United States Patent [19]

Franz

[11] 4,375,775

[45] Mar. 8, 1983

[54] STAMPING PRESS DIE SUPPORT MOUNTING

[76] Inventor: Louis J. Franz, 313 Crane Ave., Royal Oak, Mich. 48067

[21] Appl. No.: 247,725

[22] Filed: Mar. 26, 1981

[51] Int. Cl.[3] ..... B26F 1/14; B21D 28/34

[52] U.S. Cl. ..... 83/564; 83/698

[58] Field of Search ..... 83/564, 563, 698, 700, 83/621; 30/92, 361, 359; 72/448

[56] References Cited

U.S. PATENT DOCUMENTS

| | | | |
|---|---|---|---|
| 1,180,357 | 4/1916 | Whitney | 30/361 |
| 1,414,428 | 5/1922 | McCay | 30/361 |
| 2,248,642 | 7/1941 | Phillips | 30/92 X |
| 2,588,087 | 3/1952 | Connor et al. | 83/564 X |
| 3,163,071 | 12/1964 | Bergstrand | 83/564 X |
| 3,213,729 | 10/1965 | Kock | 83/124 |
| 4,192,209 | 3/1980 | Urbanski | 83/564 |

*Primary Examiner*—James M. Meister

*Attorney, Agent, or Firm*—Cullen, Sloman, Cantor, Grauer, Scott & Rutherford

[57] ABSTRACT

A precision stamping press comprises a press head reciprocally mounted upon a bed for movement, along a press axis, towards a fixed position die support which is axially aligned with the press axis. Cooperating die members are removable fastened to the press head and to the die support for stamping sheet metal placed therebetween. The die support is mounted upon one end of an elongated arm which extends transversely away from the press axis. The opposite end of the arm is pivotally connected to the bed. Thus, the die support may be swung, about the arm pivot, out of its press axis aligned position for replacement of its die member, and then swung back into axial alignment with the press axis for stamping use. Screws, which extend parallel to the press axis, releasably fasten the arm to the bed for fixing the position of the die support. Thus, tightening of the screws tends to move the die support in the direction of the press axis to maintain accurate axial alignment with the press head despite slight variances in the screw tightening pressures.

4 Claims, 7 Drawing Figures

STAMPING PRESS DIE SUPPORT MOUNTING

BACKGROUND OF INVENTION

In high speed, precision presses, such as of the type disclosed in U.S. Pat. No. 3,213,729 issued Oct. 26, 1965 to Koch, the press head and the opposed, fixed position die support or press anvil are normally accurately aligned along a horizontal press axis. The anvil is maintained in a stationary position and the press head reciprocates along the press axis towards and away from the anvil. Cooperating die members are removabley fastened to each of the head and the anvil to stamp sheet metal located between the die members.

In such type presses, which are of relatively low power or tonage, but which are extremely accurate in operation and are particularly useful for stamping very thin sheet metal parts, it is necessary to maintain highly accurate alignment between the die members. This requires maintaining accurate alignment of the press head and anvil or fixed die support along the press axis.

In commercially available presses, such as of the type described in the above patent, the anvil is normally removable from the press head in order to service or replace die members. Ordinarily the anvil is fastened to the press bed by means of screws which, when the anvil is mounted along a horizontal axis, extend downwardly into the bed. Thus, the fastening screws for the anvil normally extend transversely of the press axis. Consequently, the degree of tightening of the fastening screws effects the alignment of the anvil relative to the press axis. For example, over-tightening of the fastening screws can result in the die member carried by that anvil being too low relative the press axis. Under-tightening can result in the die member being too high. Either results in misalignments between the opposed die members. Such misalignment can cause excessive die wear, breakage of the die parts and inaccuracies in stamping thin sheet metal.

In some horizontal presses, the anvil or fixed position die support is in the form of a body member having a die receiving socket, with the body carried upon a base that is fastened by screws to the bed. As in the use described above, the screws are transversely arranged, i.e., they screw the base down against the bed. The body member is pivotally secured to the base, as for example, by horizontally extending trunions fitted into pivot sockets formed on the base. The body can be pivoted into alignment with the press head for stamping or pivoted so that its die receiving socket opens upwardly for removal and replacement of the die members fitted within the socket. A suitable locking means holds the body in the press head alignment position. However, in this instance, die misalignments also occur due to the tolerances or looseness required between the trunions and sockets and also due to the body locking means. Moreover, the base fastening screws likewise cause some misalignments.

Where the sheet metal being stamped is of thin gauge, as for example, less than one thousanths of an inch in thickness, the maintenance of axial alignment of the head, anvil and the opposed die members, is critical. Even slight misalignments resulting from over-tightening or under-tightening of the fastening screws or the body pivots, seriously effect the die operation, die life and stamping accuracy.

Consequently, the invention herein is concerned with providing a means for fastening the die support or anvil upon the press bed in a manner which is unaffected by the amount of tightening of the fastening screws and simultaneously, provides a simple system for moving the fixed die support into a position where its die members can be easily removed and replaced.

SUMMARY OF INVENTION

The invention herein relates to a precision press having a press head reciprocally mounted upon a bed and an aligned, fixed position die support or anvil which is releasably fastened to the bed by fasteners which apply forces that are parallel to the press axis so that variations in fastener pressure do not effect the alignment of the anvil along the press axis. Further, the die support may be pivoted relative to the bed for simplifying the replacement of dies mounted upon the die support.

The invention contemplates mounting the fixed die support or anvil upon an end of an elongated arm which extends transversely to the press axis, and whose opposite end is pivotally connected to the bed. Thus, by swinging the arm about its pivot, the anvil is swung either out of or into alignment with the axis of the press. Preferably, the arm extends vertically downwardly beneath the horizontal press axis. Thus, when the anvil is swung out of press alignment, the die member which is mounted upon it, is arranged upon the now upper surface of the anvil. Therefore, the die member can be easily serviced and replaced.

Return of the anvil into the press axis alignment position for use involves swinging the anvil about the arm pivot. The anvil is then fastened to the bed by means of screws which extend through portions of the arm into the bed. The screws are parallel to the press axis. Thus, tightening of the screws moves the anvil along the direction of the press axis towards the press head. Over-tightening or under-tightening of the arm screws have virtually no effect upon the accurate alignment of the anvil relative to the press axis, because the force of the screws is directed parallel to the press axis.

Hence, an object of this invention is to provide a means for rapidly opening or removing the press anvil or fixed die support for access to the die members secured thereon, and re-fastening the anvil in press operation position by fastening means whose forces are arranged parallel to the press axis so that slight variations in such fastening forces, as may be due to over-tightening or under-tightening the fastening screws, are immaterial to the accuracy of location of the press anvil and its die members.

Another object of this invention is to mount the press anvil upon a swinging arm arrangement, with the anvil normally locked in place with easily openable screws or the like mechanical fasteners, so that the press may be opened and the die members serviced with minimal time and effort and without the need for accurate measurements or alignment steps as has been required in the past on conventional presses of this type.

These and other objects and advantages of this invention will become apparent upon reading the following descriptions, of which the attached drawings form a part.

DETAILED DESCRIPTION

Figure 1:
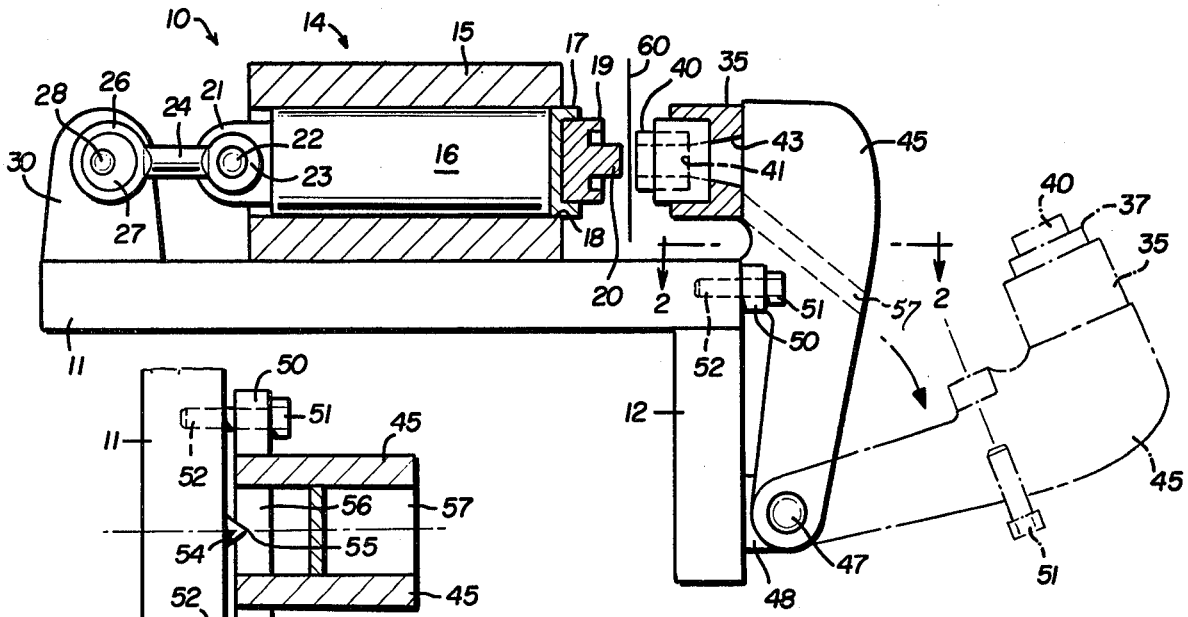
FIG. 1 is a schematic, elevational view, partially in cross section, showing a precision horizontal stamping press with the die support mounting illustrated in stamping position and also in open position.

FIG. 1 illustrates a horizontal stamping press, generally designated 10, which comprises a bed 11 and a front frame plate 12. A press head 14 is fastened upon the bed 11 by suitable mechanical fasteners, not illustrated.

The press head comprises a housing 15 within which a reciprocating ram 16 is journalled for reciprocating along a horizontal axis. A die retainer 17 is mounted on the lead end of the ram.

The die retainer includes a mounting socket 18 within which a typical die 19 is positioned and locked. The die may include an integral punch 20 or alternatively, a separately operating punch, such as illustrated, for example, in the above mentioned U.S. Pat. No. 3,213,729 to Koch issued Oct. 26, 1965 for a punch press.

The ram 16 is provided with a suitable power mechanism to reciprocate it rapidly when required. An example of a type of power system, which is schematically illustrated, includes a bracket 21 mounted on the end of the ram and connected through a pin 22 to the end 23 of a power link 24. The opposite end 26 of the link has an opening which receives an eccentric 27 mounted upon a drive shaft 29 which is connected to a suitable motor (not shown). The drive shaft is journalled within a support bracket 30 mounted upon the bed 11.

The horizontal stamping press described above is schematically illustrated and described in general since its precise construction forms no part of the invention herein. Rather, the invention herein is concerned with the mounting arrangement of the anvil or die support 35.

The anvil or die support is essentially a block or body of metal having a socket 36 which receives a conventional die retainer 37. A conventional compound die 40 is mounted within the die retainer and secured therein by suitable locking screws or the like.

The die may include a punch receiving opening 41. In that case, a scrap opening 43 is formed through the anvil for passage outwardly of scrap metal. All of the above description is conventional. Thus, the compound die may be made in a number of different shapes and styles and includes a number of different elements, which are omitted here since they form no part of the invention.

The anvil or die support is mounted upon the upper end of a pair of closely parallel arms 45 which together form a single arm unit. The arms are provided with pivot openings 46 at their lower ends. A pivot pin 47 extends through the pivot openings 46 and through the opening of a pivot bracket 48 which is permanently fastened upon the front frame plate 12 of the press. Thus, the arms may be pivoted or swung into the positions illustrated in solid lines and in dotted lines of FIG. 1.

The arms are held in their upright position by means of integral lugs 50, formed on each of the arms, through which screws 51 are passed to threadedly interlock within threaded screw holes 52 formed in the press frame plate 12.

Figure 2:
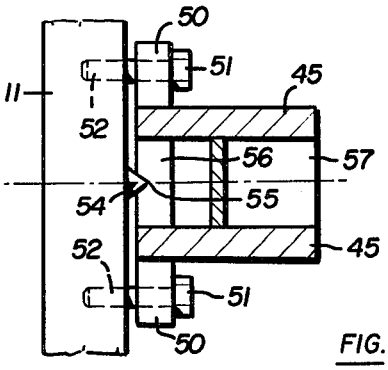
FIG. 2 is an enlarged, cross sectional, fragmentary view taken in the direction of arrows 2—2 of FIG. 1.
Figure 3:
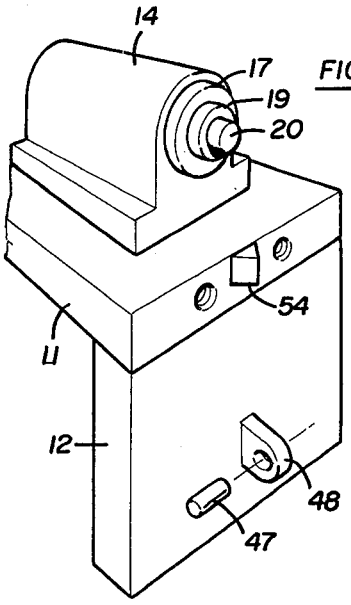
FIG. 3 is a perspective view of a portion of the press.

In order to align the arms in a vertical plane which contains the center line of the press head and ram, a key is provided. One form of key which is illustrated in FIGS. 2–3, comprises a wedge shaped tongue-like key 54 formed or mounted upon the bed for fitting into a correspondingly shaped notch 55 formed in a plate 56 which is fastened between the arms.

The arms are further interconnected by a brace 57 that extends between them and preferably is sloped so as to assist in the removal of scrap.

Figure 5:
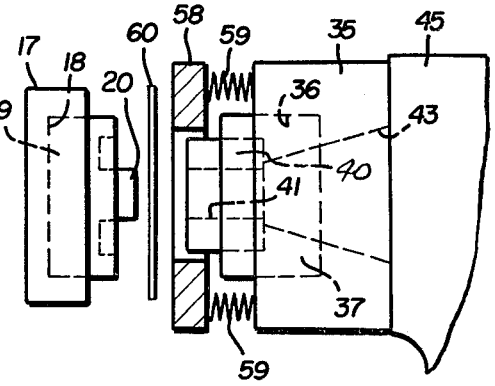
FIG. 5 is an enlarged, partially cross section view, showing the opposed press head and die support or anvil die members in alignment for stamping sheet metal located therebetween.

In a typical horizontal type of press, a conventional stripper plate 58 is connected by springs 59 to the anvil or die support in order to assist in stripping the stamped metal from the dies. Thus, FIG. 5 schematically illustrates such a stripper plate with a section of sheet metal 60 located between the dies in position for stamping. By using appropriately shaped dies, the sheet metal stampings may be formed as desired.

Figure 6:
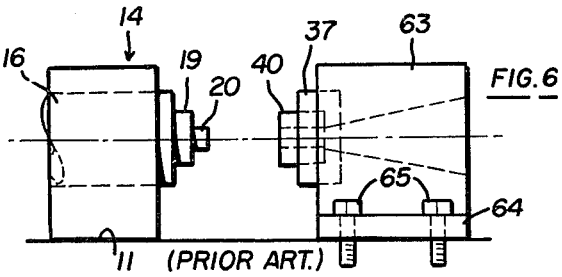
(PRIOR ART.) FIG. 6
FIG. 6 is a schematic view showing a prior art die support mounting using conventional transversely arranged mounting screws.

In order to contrast the improvement of this invention with the prior art anvil mountings, FIG. 6 shows one form of conventional horizontal press which is similar to the one described in the above mentioned Koch U.S. Pat. No. 3,213,729. In FIG. 6, the prior art anvil 63 is provided with base flanges 64 which are fastened to the bed of the press by means of screws 65 extending downwardly through the bed, and interlocking with threaded holes formed in the bed. Thus, the screws are arranged transversely to the bed. Consequently, over-tightening or under-tightening the screws cause a vertical misalignment of the anvil and its die members relative to the axis of the press.

Figure 7:
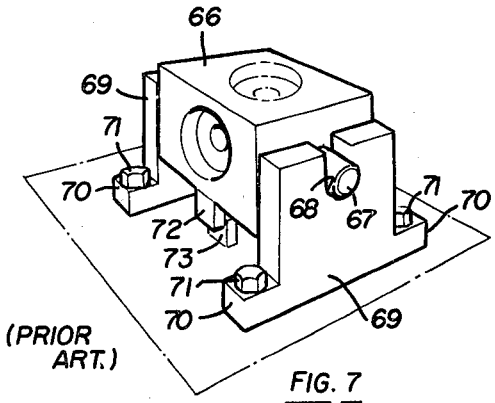
(PRIOR ART.) FIG. 7
FIG. 7 is a perspective view, schematically showing another prior art die support mounting utilizing a pivotal trunion arrangement.

FIG. 7 illustrates another prior art technique used for mounting the anvil upon the bed. Here, the anvil 66 is provided with horizontally extending trunions 67 which are received within upwardly opening grooves 68 formed in trunion mounting plates 69. The plates are provided with flanges 70 through which screws 71 are extended to fasten the plates to the press bed.

The anvil 66 may be arranged in the horizontal aligned direction where its socket, and die member contained within the socket, are horizontally oriented. Alternatively, it may be swung about its trunions so as to position its socket upwardly, as illustrated in dotted lines in FIG. 7. In that manner, the die members can be easily reached and serviced.

In order to align the anvil upon the bed, a stop pad 72 may be formed at its lower edge for engaging a stop 73 mounted upon the bed. In addition, locking means (not shown) may be provided to hold the anvil in its horizontal alignment position.

The rotatable type of anvil may be misaligned due to the "play" or tolerances required for the trunion mounting and pivoting, as well as because of the misalignments incurred because of the fastening screws 70.

In contrast, the arm mounting system of the invention herein results in virtually no misalignments due to the forces of the arm fastening screws 51 being directed parallel to the axis of the press. Thus, any over-tightening or under-tightening may cause the anvil or die support 35 to move closer or further from the press head, which is immaterial to the operation because the reciprocating ram makes up for the difference in location of the anvil. However, the tightening of the screws prevents vertical misalignment of the anvil relative to the press axis.

Figure 4:
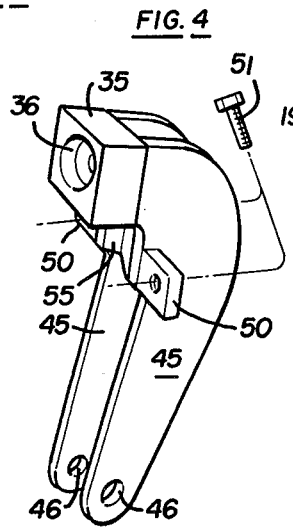
FIG. 4 is a perspective view of the die support mounting arms.

A suitable tongue and groove or key arrangement, such as illustrated in FIGS. 2 and 3-4, keep the anvil aligned within the vertical plane containing the press axis. Moreover, the pivot location for the arms is sufficiently far from the press axis so as to minimize or negate any minor inaccuracies as may occur because of the looseness of the connection between the pivot pin and the openings in the arm or pivot bracket. Consequently, this die support or anvil mounting means provides a precision location for the typical compound die that is utilized in presses of the character described. Although the press is described as being a horizontally axised press, which is the preferred embodiment, it could be utilized in a vertical press of the same type but of a vertical orientation.

Having fully described an operative embodiment of this invention, I now claim:

1. In a horizontally axised stamping press having a horizontal bed and a reciprocating press head mounted upon the bed for horizontal reciprocating movement along a press axis; with a die support member arranged in alignment with the press axis, and opposing die members removably mounted upon the press head and die support member for relative movement together and apart for thereby engaging and stamping sheet metal positioned between the die members, the improvement comprising:

a vertically arranged arm pivotally connected to the bed at a considerable distance below the press axis, with the die support member mounted upon the upper end of the arm, and with the arm being pivotable about a horizontal axis which is transverse to the press axis, to swing the die support along an arc downwardly away from the press head so that its die member is generally upwardly oriented for thereby removing and replacing said die member when desired;

and a screw receiving member formed on said arm for horizontal alignment with a horizontally axised, threaded screw receiving socket formed in the bed adjacent the arm, with a screw interconnecting said screw receiving member and socket and aligned parallel to, but spaced downwardly from, the press axis, so that tightening the screw moves the arm towards the press head with the die support member and its die member thereby maintaining their horizontal press axis alignment during said screw tightening.

2. In a stamping press as defined in claim 1, and including interengaging alignment means formed on the bed and arm for guiding the arm movement in the vertical plane containing the press axis during tightening of the screw.

3. In a stamping press as defined in claim 2, and including a second arm, which is substantially identical to, and arranged parallel to, but spaced a short distance from the first arm, with the second arm likewise being pivotably connected so that the two arms move together, and said die support extending between the upper ends of the two arms, and including a second screw receiving member formed on the second arm with a screw extending therethrough into a screw receiving socket formed in the bed, with the second arm screw likewise being in parallel alignment with the press axis.

4. In a stamping press having a bed, a press head reciprocally mounted upon the bed for movement, along a press axis, towards a fixed press die support aligned with said press axis, with opposing die members removably mounted upon the press head and die support, respectively, and aligned with the press axis for thereby engaging and stamping sheet metal positioned between the die members, the improvement comprising;

an elongated arm having one end secured to and carrying the die support, and an opposite end pivotally connected to the bed at a location remote from the press axis, and with the arm extending a considerable distance transversely of the press axis, so that the arm may be swung about its pivotable connection to swing the die support out of and into alignment with the press axis;

and releasable fastening means securing the arm to the bed, near the die support, and applying a fastening force in a direction which is substantially parallel to the press axis;

at least one screw extending through a screw receiving member formed on the arm, adjacent to the die support, and into a screw receiving opening in the bed for extending substantially parallel to the press axis, so that the screw fastening force is substantially parallel to the press axis whereby tightening of the screw tends to move the die support in the direction of the press axis towards the press head;

said press axis being horizontal and said arm extending downwardly from the die support, so that the die support may be swung in a roughly horizontal position with its die member located upon the uppermost portion of the die support for thereby positioning the die member in a generally horizontal plane to simplify removal of and replacement of die member;

another arm, substantially identical to and parallel to, but spaced a short distance from the first mentioned arm, and a pivot means interconnecting one end of each of said arms to form the pivotal connection with the bed, and said die support extending between the opposite ends of the two arms, and a screw fastening each of the arms to the bed, below, but close to, the die support, with the screw extending substantially parallel to the press axis.

* * * * *